US005620160A

United States Patent [19]

Grabe

[11] Patent Number: 5,620,160

[45] Date of Patent: Apr. 15, 1997

[54] SHELF SUPPORT ASSEMBLY

[76] Inventor: Charles R. Grabe, 1057 General Sullivan Dr., West Chester, Pa. 19382

[21] Appl. No.: 658,248

[22] Filed: Jun. 4, 1996

Related U.S. Application Data

[63] Continuation of Ser. No. 217,058, Mar. 24, 1994, abandoned.

[51] Int. Cl.[6] ..... A47G 29/02

[52] U.S. Cl. ..... 248/235; 248/248

[58] Field of Search ..... 248/248, 235, 248/675, 475.1, 236, 547, 251; 52/36.1, 36.4, 514

[56] References Cited

U.S. PATENT DOCUMENTS

| | | | |
|---|---|---|---|
| 1,579,556 | 4/1926 | McKenzie | 248/248 |
| 3,669,395 | 6/1972 | Gehrke | 248/235 |
| 3,675,882 | 7/1972 | Dibble | 248/235 |

*Primary Examiner*—Leslie A. Braun
*Assistant Examiner*—Willie Berry, Jr.

[57] ABSTRACT

A shelf support assembly formed of particle board is disclosed. The assembly includes a generally right triangular shaped main body having flat upper and inner sections for receiving a shelf and for abutting a wall surface, respectively. The upper section has an indentation at its inner end which receives an L-shaped bracket for use in securing the shelf support to a wall surface. The L-shaped bracket is fixed to the main body by a screw. A second screw extends laterally into the main body in the vicinity of the L-shaped bracket screw and serves to hold the particle board from separating due to the penetration into the body of the L-shaped bracket screw and downwardly directed force on the body. A third screw extends through a lower region of the body between its outer and inner sections for supplementing attachment of the assembly to a wall surface. A fourth screw extends laterally into the sides of the body in the region of the third screw for holding the particle board against separating due to the penetration into the body of the third screw. A rod support bracket is fixed to an outer and upper vicinity of the body.

5 Claims, 2 Drawing Sheets

SHELF SUPPORT ASSEMBLY

This patent application is a Continuation of U.S. patent application Ser. No. 08/217,058, filed Mar. 24, 1994, in the name of Charles R. Grabe for Shelf Support Assembly, now abandoned.

BACKGROUND OF THE INVENTION

This invention relates to a shelf support assembly and particularly to a shelf support assembly having a main body formed from particle board.

Various types of support arrangements are known for supporting shelving on wall surfaces. One such support is a metal L-shaped bracket secured in pairs to the wall. Another support arrangement, typically found in closets, is comprised of wood strips fixed to the rear and side walls with a shelf laid on the top edges of the strips. California closets use upright standards with clip-like support members received in the standards upon which shelves are mounted. Solid wood brackets fixed to wall surfaces are also used as shelf supports.

All of the above mentioned shelf support arrangements have inherent disadvantages. The L-shaped metal brackets are unattractive and are generally not constructed to bear heavy weighted storage items. The wood strip arrangements are expensive and limited to closets and are also not suitable to permit heavy weights. The upright standards are not always desirable and are more suitable to multi-shelf arrangements in closets. The solid wood brackets are basically expensive.

The shelf support assembly of this invention overcomes the above mentioned drawbacks of existing shelf supports by providing a structure which is relatively inexpensive to produce, is attractive in appearance, and when used in multiples to support shelving permits surprisingly heavy weights of stored items to be supported. Additionally, the shelf support assembly of this invention is simply and inexpensively formed, and is easily installed on wall surfaces.

SUMMARY OF THE INVENTION

This invention provides a novel shelf support assembly which in its preferred form comprises: a generally flat triangular shaped body formed from particle board; the body member has opposite flat side faces, an elongated linear inner section shaped to snugly abut a wall surface, an outer section which would be the hypotenuse of the triangle, and an elongated upper section to receive a shelf member; the upper section having an indentation on its inner end region; a first securing means including a generally L-shaped bracket received in the indentation for securing the body member to a wall surface; attachment means such as a screw, for attaching the bracket to the body; and a first holding means, such as a second screw, extending laterally of the side faces in the region of the indentation for holding the body against splitting or separating due to the penetration of the attachment means into the body and the application of a downward force on the body. An additional and supplemental securing means may be provided in the form of a screw through the lower inner end of the body for securing the shelf bracket to a wall. The supplemental screw would penetrate into the body through the outer and inner sections and into a wall surface. A second holding means could be added to hold the body from splitting or separating due to the penetration of the supplemental securing screw into the body of the shelf bracket. A rod support bracket may be fixed to an outer vicinity of the body whereby a clothes hanging rod may be supported between a pair of shelf support assemblies.

Various other advantages, details, and modifications of the present invention will become apparent as the following description of a certain present preferred embodiment proceeds.

DESCRIPTION OF THE DRAWINGS

In the accompanying drawings I show a certain present preferred embodiment in which.

DESCRIPTION OF A PREFERRED EMBODIMENT

Figure 1:
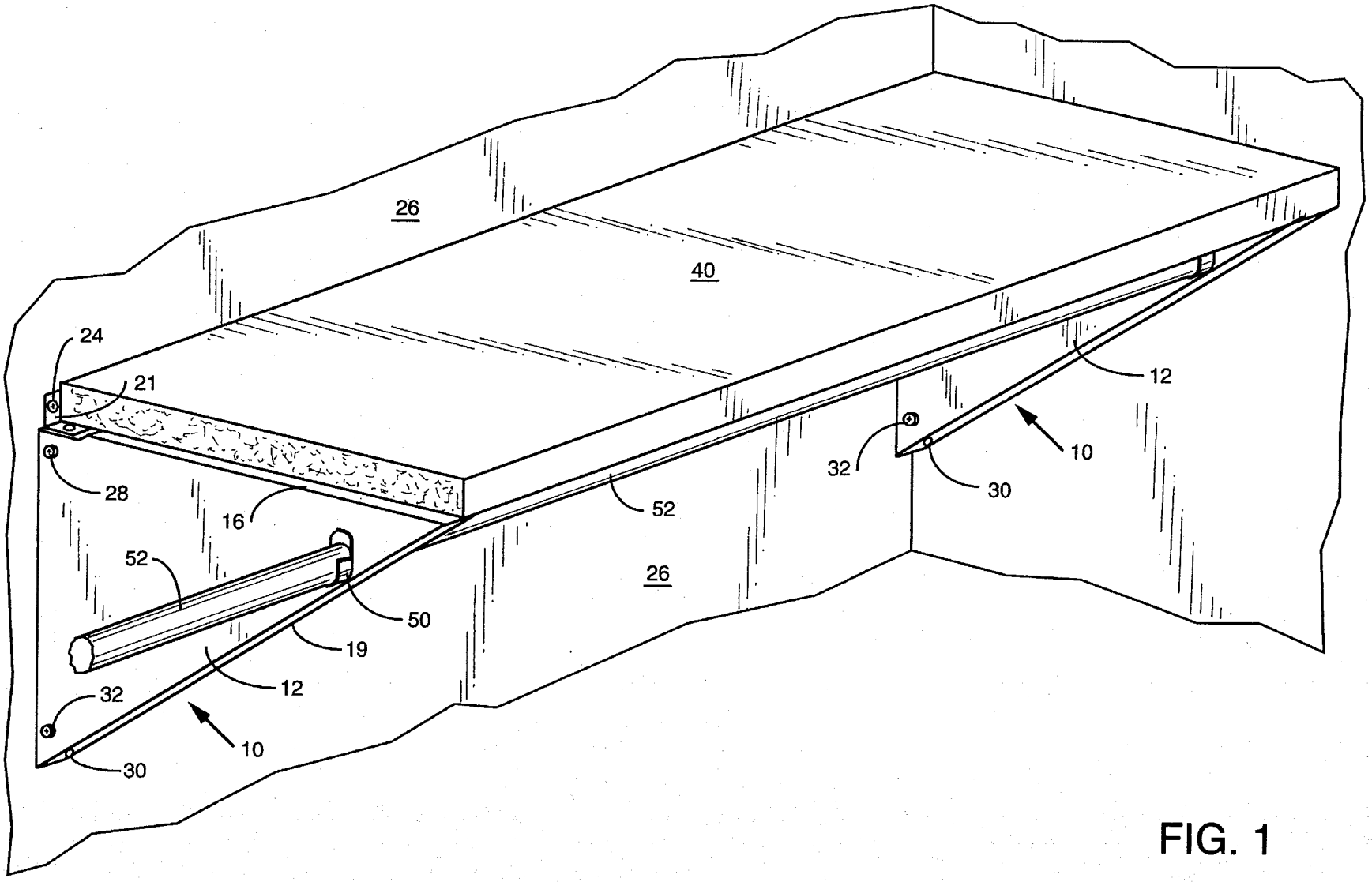
FIG. 1 is a perspective view showing a pair of generally parallel shelf bracket assemblies of the present invention supporting a section of shelving and a clothes hanging rod.
Figure 2:
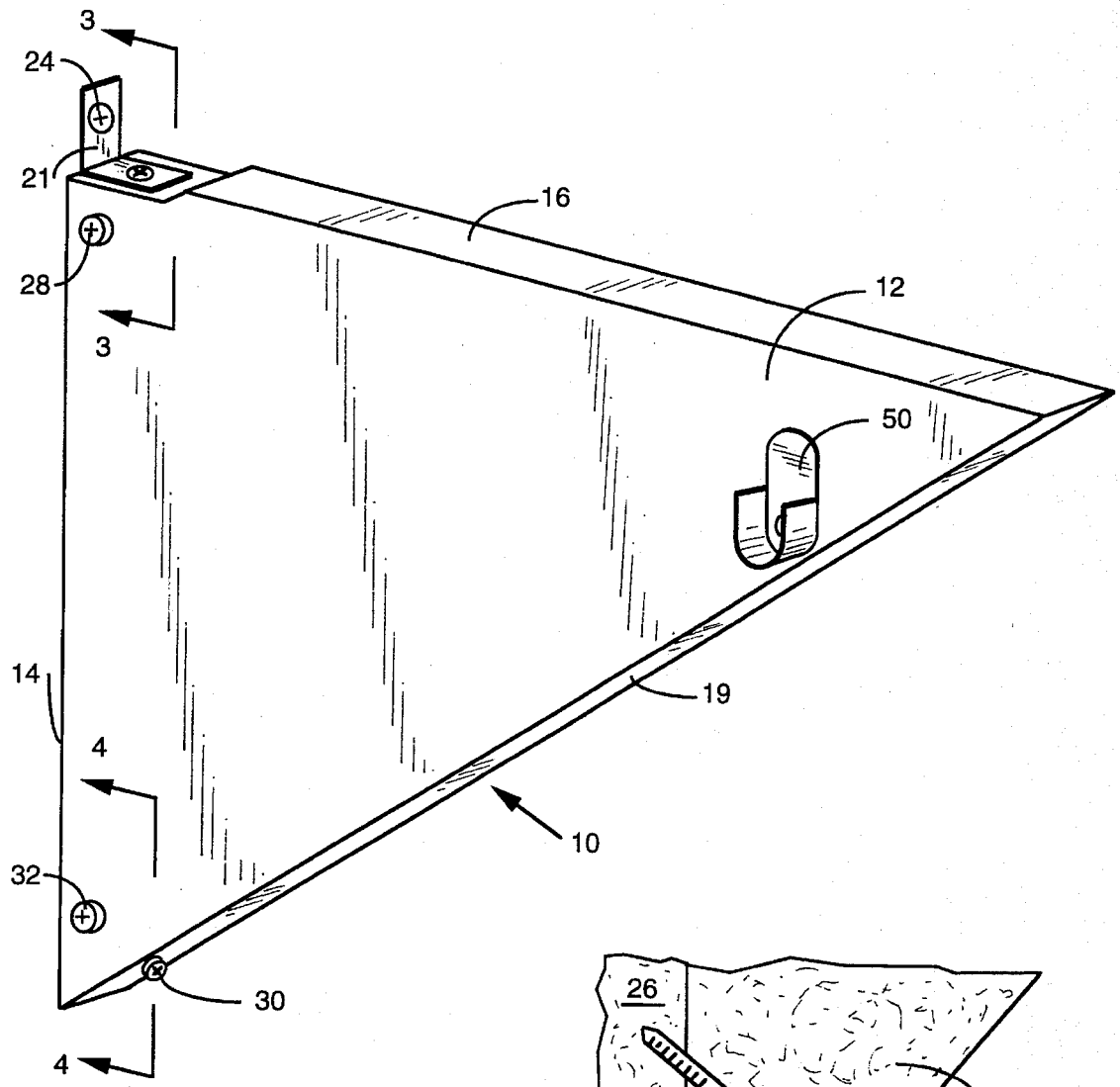
FIG. 2 is an enlarged perspective view of one of the shelf support assemblies of the present invention.
Figure 3:
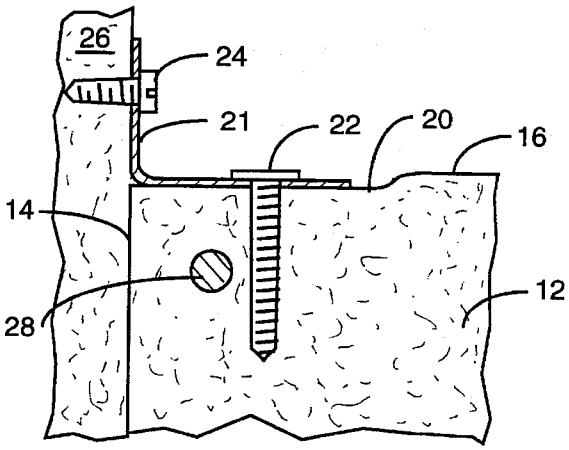
FIG. 3 is a side elevation sectional view through line III—III of FIG. 2, showing the details of the L-shaped bracket and upper holding screw in relation to the particle board body of the shelf support of the present invention.
Figure 4:
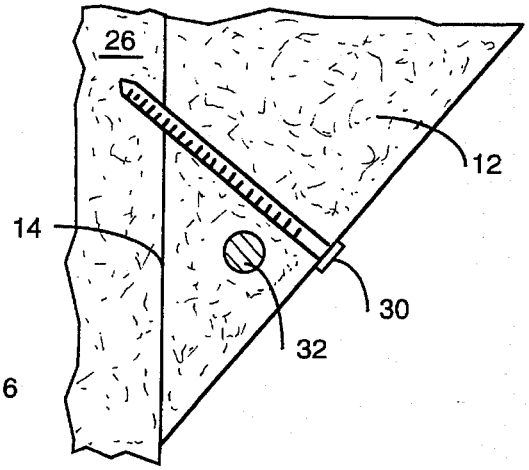
FIG. 4 is a side elevation sectional view through line IV—IV of FIG. 2, showing the details of the lower securing screw and lower holding screw in relation to the particle board body of the shelf support of the present invention.

Referring now to the drawings, 10 generally refers to a shelf support assembly embodying the present invention. The shelf support assembly 10 includes a generally right triangular shaped flat main body member 12 formed of particle board, the construction of such particle board being old and well known. Particle board is formed under pressure by well known processes and is characterized by a somewhat layered wood particle or granular structure. Should objects such as nails or screws penetrate a particle board parallel to the layered direction of the grain the grain of the board will tend to split or separate. The tendency of the board to split or separate is increased when a downward force is applied to the board as would occur when a load is placed on a board of the main body member 12. The particle board is also very strong both along and across the grain layers. This invention provides means to prevent splitting or separating of the grain of the particle board forming body member 12 while making use of the strength characteristics of that same particle board.

The triangular main body member 12 has opposite side faces, an elongated linear inner section 14 (one leg of the triangle) which snugly abuts a wall surface, an elongated upper section 16 (another leg of the triangle) for receiving an underside section of a shelf 18, and an outer section 19 (the hypotenuse of the triangle) opposite the inner section. The upper section 16 is provided with an indentation 20 at its inner end region. Received on the indentation 20 is an L-shaped bracket 21 having a first leg attached to the body member 12 by a first screw 22 penetrating into the grain layers of particle board. The depending upwardly extending second leg of the L-shaped bracket 21 is provided with an opening through which a second screw 24 passes for securing the body member 12 to wall surface 26. A first holding means in the form of third screw 28 laterally penetrates the particle board of body member 12 in the region of and below the indentation 20. The third screw 28 extends across the layered grain of the particle board and serves to hold the particle board from splitting or separating due to the penetration of the first screw 22 into the layered grain and whenever a downward force is applied to the body member 12, as would occur when a load is placed in the assembly.

Although the L-shaped bracket 21 and second screw 24, as shown and described, would be sufficient for securing the body member 12 to wall surface 26, additional or supplemental securing means may be provided in the form of a fourth screw 30 extending from the outer section of the body member 12 angularly through the layered grain of the particle board and out of the inner section 14 and into the wall surface 26. The penetration of the fourth screw 30 would tend to split or separate the layered grain of the particle board and to prevent that result a fifth screw 32 laterally penetrates the body member 12 below the fourth screw 30.

With a shelf 40 supported by at least of pair of shelf support assemblies 10 secured to a wall surface, and a load placed on the shelf, the force of the load's weight will tend to split or separate the grain of the particle board body member 12 and pivot the shelf support downwardly away from the wall surface. To resist the tendency of the shelf support to pivot downwardly with the bracket 21 remaining fixed in place, it is preferable to locate the third screw 24 on the inner section 19 side of the main body member 14 and securing first screw 22. By so positioning the third screw 24, it will serve as a stop against the downward pivoting movement of the main body member 12.

A standard rod support bracket 50 is fixed to an outer and upper end vicinity of the body member 12, and as shown, a clothes hanging rod 52 is supported between a parallel pair of wall mounted shelf support assemblies 10.

It has been found that a pair of parallel shelf support assemblies 10 secured as described to a wall surface about thirty two inches apart is able to support about 750 pounds of weight on a shelf supported by the assemblies. Without the combined elements of this invention, it is estimated that a pair of support brackets of any of the well known old designs could support between 120 and 150 pounds of weight.

It should be now clearly understood how the shelf support assembly of this invention achieves the new results and advantages recited in the introductory section of this specification. It is also to be noted that the right triangular shaped assembly illustrated is an isosceles triangle and the best shape from an aesthetic standpoint. The shape of the assembly need not be an isosceles right triangle. The surface of the shelf support may be laminated with a hard, smooth Melamine finish of a desirable color. Also, the rod support brackets 50 may be removable if the use of a clothes hanging rod is not, desired. The holding means represented by third screw 24 and fifth screw 32 may be replaced by other fasteners such as nails, bolts and nuts, or clips surrounding portions of the edges of the main body member 12.

While I have shown and described a certain present preferred embodiment of this invention, it is to be distinctly understood that the invention is not limited thereto, but may be embodied within the scope of the following claims.

I claim:

1. A shelf support assembly comprising:

a generally flat body member formed from particle board;

said body member having opposite flat side faces, a generally elongated linear inner section shaped to snugly abut a planar wall surface, an outer section opposite said inner section, and an elongated top section shaped to receive an underside section of a flat shelf member, said top section having an indentation at an inner end region;

a first securing means including a generally L-shaped bracket member received in said indentation for securing said body member for securing said body member to a wall surface;

attachment means penetrating into said body for attaching said first securing means to said body; and first holding means extending laterally of said side faces in the region of said first securing means and adjacent to and on the inner section of said body member side of said first attachment means and adjacent said attachment means and said first securing means for holding said body member against splitting or separating due to the penetration of said attachment means into said body member and/or the application of a downwardly directed force on said body member.

2. A shelf support assembly as set forth in claim 1 wherein said first holding means is a screw member extending into said body member.

3. A shelf support assembly as set forth in claim 1 including second securing means extending through said body member between said outer and inner section regions and at a lower place of said inner section for supplementing the securing of said body member to a wall surface.

4. A shelf support assembly as set forth in claim 3 including a second holding means extending laterally of said side faces in the region of said second securing means for holding said body members against splitting or separating due to the penetration of said second securing means into said body member and/or the application of a downwardly directed force on said body member.

5. A shelf support assembly as set forth in claim 1 including a rod support bracket secured to an outer vicinity of said body member.

* * * * *